United States Patent [19]

Brown

[11] 4,040,180

[45] Aug. 9, 1977

[54] WIRE CONE ASSEMBLY

[75] Inventor: Leon Richard Brown, Harrisburg, Pa.

[73] Assignee: AMP Incorporated, Harrisburg, Pa.

[21] Appl. No.: 696,258

[22] Filed: June 15, 1976

[51] Int. Cl.[2] ..... H01R 43/04

[52] U.S. Cl. ..... 29/753; 29/759

[58] Field of Search ..... 29/203 D, 203 DT, 203 DS, 29/203 P, 203 R, 628, 630 A, 208 D, 211 R, 282, 243.57

[56] References Cited

U.S. PATENT DOCUMENTS

| | | | |
|---|---|---|---|
| 2,545,756 | 3/1951 | Andren | 29/211 R X |
| 2,939,505 | 6/1960 | Bucher et al. | 29/282 X |
| 3,264,860 | 8/1966 | Herb | 72/457 |
| 3,416,213 | 12/1968 | Cootes | 29/243.57 X |
| 3,550,239 | 1/1971 | Rider | 29/203 DS |
| 3,710,483 | 1/1973 | Morgan et al. | 29/203 DT |

*Primary Examiner*—Milton S. Mehr
*Attorney, Agent, or Firm*—Allan B. Osborne

[57] ABSTRACT

The present invention relates to a wire cone assembly for use on high speed magazine or reel-fed crimping machines. More particularly the invention comprises an elongated cone support arm with a mounting bracket on one end and a three quarter wire cone funnel pivotably mounted on the other end.

5 Claims, 5 Drawing Figures

22
12
16
48
40
50
30
60
52
56
28
32
34
38

WIRE CONE ASSEMBLY

BACKGROUND OF THE PRESENT INVENTION

1. Field of the Invention

The present invention is in the crimping machine field and more particularly in the field of providing means for funneling stranded wire into a closed wire barrel terminal preparatory to dies on the machine crimping the wire barrel around the wire in tightly encompassing relation.

2. Prior Art

Where closed wire barrel terminals are being crimped around stranded wire in high speed operations, some means must be provided to channel the wire strands into the barrel quickly, effortlessly and accurately. Obviously a funnel-like device provides an appropriate means.

As would be expected, funnels per se are not generally the subject matter of patents, such devices being well known and used in every application requiring the gathering or bunching of discrete objects. Accordingly from the beginning, high speed crimping machines utilized funnels such as shown on the apparatus disclosed in U.S. Pat. No. 2,939,505.

Some variations have been introduced; an example is disclosed in U.S. Pat. No. 3,416,213 wherein a split funnel is employed so as to facilitate releasing and removing the crimped terminal from the crimping station. However the basic cone-shaped funnel shape has prevailed.

More recently as a result of increasing labor costs, machine innovators have been seeking ways to reduce applied costs; i.e., increase the number of terminations per unit time. Machine speed is only one factor and is limited by operator dexterity in feeding the wire strands into the funnel and the wire barrel beyond. OSHA regulations requiring operator shielding guards obviously complicates the operation and actually slows it down in some cases.

One problem which has been discovered in studies relative to feeding wire into the funnel is that not withstanding the wide mouth, the operator must bring his or her line of sight down to or near the funnel level in order to poke the wire strands in. As the eye level of the operator is above that level, considerable time is lost.

Accordingly the present invention provides a wire cone assembly wherein the funnel describes less than a 360° circle; i.e., a segment of the funnel along its longitudinal axis has been removed to enable the operator to feed the wire strands thereinto in a combination poking and laying movement.

Figure 4:
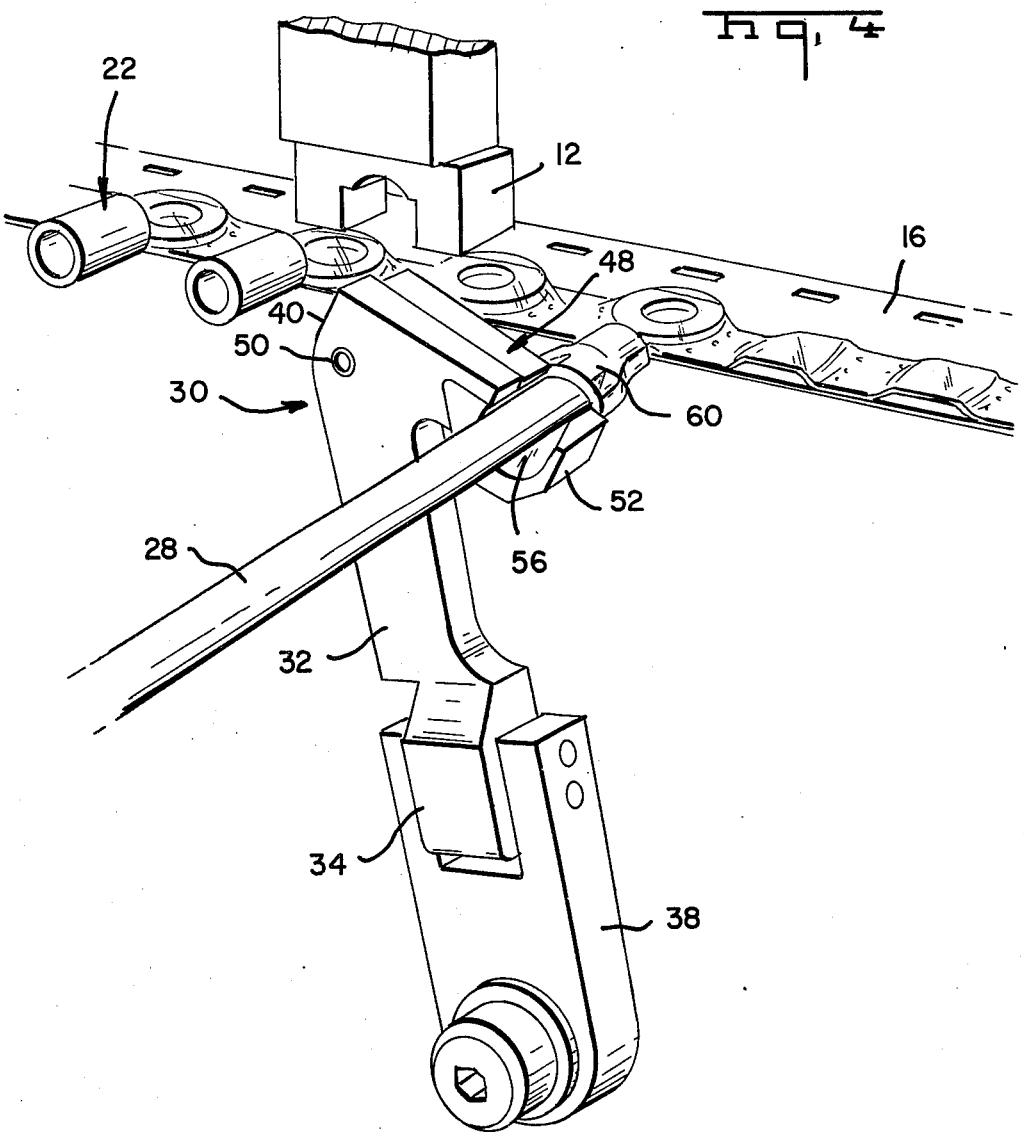

FIGS. *2a* and *2b* are perspective views of the preferred embodiment of the present invention;

FIGS. 3 and 4 are perspective views illustrating the positioning and operation of the preferred embodiment on a crimping press.

DESCRIPTION OF THE PREFERRED EMBODIMENT

Figure 1:
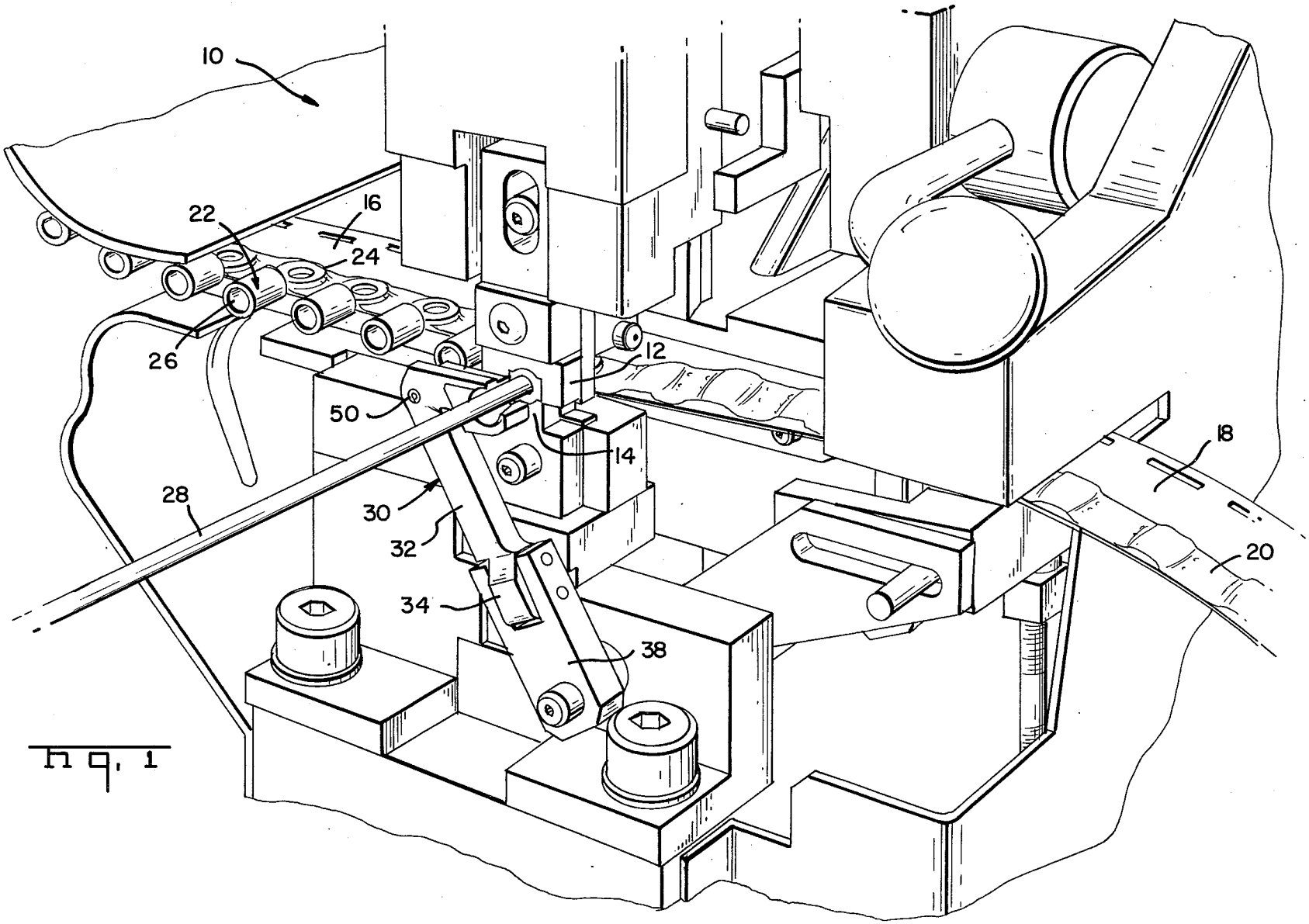
FIG. 1 is a perspective view showing the preferred embodiment of the present invention attached to a crimping press.

A high speed, reel-fed crimping machine 10 shown in FIG. 1 includes a crimping station having crimping dies consisting of a moving indenter 12 and an underlying anvil 14. A carrier strip 16 of plastic film such as Mylar is fed through the crimping station from a reel (not shown) to the left of the machine. The strip consists of a wide base layer 18 and a narrower top layer 20. Terminals 22 are removably secured thereto by its front ring-tongue 24 being encapsulated between the two layers. The terminal's closed wire barrel 26 extends laterally from the edge of the strip as shown so as to be freely positioned on the anvil 14. Subsequent to the barrel being seated on the anvil, the bared end (not shown) of wire 28 is inserted thereinto and the indenter 12 descends to crimp the barrel into a tight encompassing engagement about the bared wire end. The mechanism in the machine, either automatically or upon the operator's command, advances the strip so that the crimped terminal is moved off the anvil (indenter 12 having been raised) and the next, uncrimped terminal 22 is moved onto the anvil.

The above description is abbreviated for the reason that such is well known in the art and does not constitute part of the present invention. However, for those who would like to have more information about such mechanism, reference is made to U.S. Pat. No. 3,553,814.

The present invention discloses an improved wire cone assembly 30 located on machine 10 immediately in front of the crimping station. Wire cone assembly 30 provides a means for an operator to insert the bared end of a multi-stranded wire into wire barrel 26 without individual strands (not shown) being bent and uninsertable.

Figure 2A:
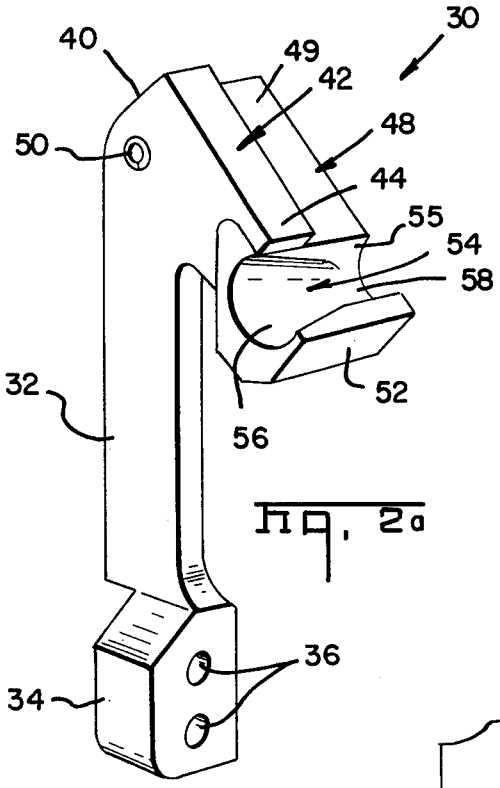

FIG. 2a illustrates wire cone assembly 30 in perspective. It has an elongated arm 32 with a mounting bracket 34 on its lower end. The bracket is thicker than the arm and has a pair of bolt-receiving holes 36 therethrough. As shown in FIG. 1, the assembly 30 is fixed to forked mounting block 38 which is pivotably secured to the front of machine 10.

The top end 40 of the arm has an elongated hook-like or laterally projecting member 42 extending laterally relative to the arm. The underside of the member has been cut back to provide a stop means or finger 44.

The assembly 30 further includes an enlongated, L-shaped lever 48 having a first section 49 with its free end pivotally attached to one side of the laterally projecting member 42 by pin 50. The first section extends parallel to the member 42. The second section 52 is positioned at a right angle to the first section and extends across the front of the laterally projecting member and beneath the finger 44. The second section 52 has a passage 54 therethrough providing a wire cone funnel. A slot 55, located on an upwardly facing surface of the second section and extending the length thereof, intersects passage 54. The lead in section 56 of the passage is conical; i.e., its walls are converging for about one-half its length. The walls 58 of the remaining length are straight.

A torsion spring (not shown) attached to pin 50 biases the free end of the lever upwardly, with finger 44 providing a stop or limiting means. Interference with the side of arm 32 limits the lever's downward travel.

FIG. *2b* , a front view of the upper half of the wire cone assembly, shows the lever in a pivoted position; i.e., it has been rotated clockwise to where second section 52 abuts the side of arm 32.

FIG. 3 is a view similar to FIG. 1 but is facing more directly into machine 10 and wire cone assembly 30. The assembly remains in the position shown during the steps of feeding a wire into wire barrel 26 through funnel 56, and during the crimping of the barrel around the wire. Considering both FIGS. 1 and 3, it can be seen that the operator does not have to move wire 28 straight forward into a closed funnel but rather places and inserts the wire through slot 55 with a combination forward thrust and laying down motion. The head of the operator remains erect; i.e., he or she does not have to bend down in order to bring the eye to the same level as the funnel. As a consequence of the present invention, termination rates have increased from 1600 to 2500 terminations per hour on a crimping press manufactured by AMP Incorporated of Harrisburg, Pa. under the trademark of AMP-TAPETRONIC Press No. 69875.

Figure 2B:
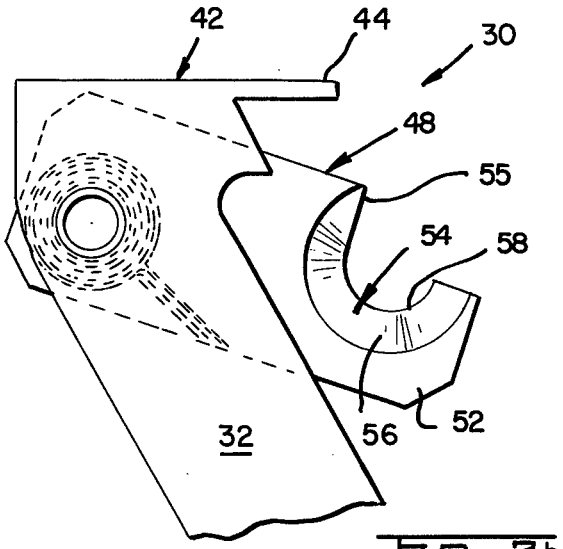
Figure 7:
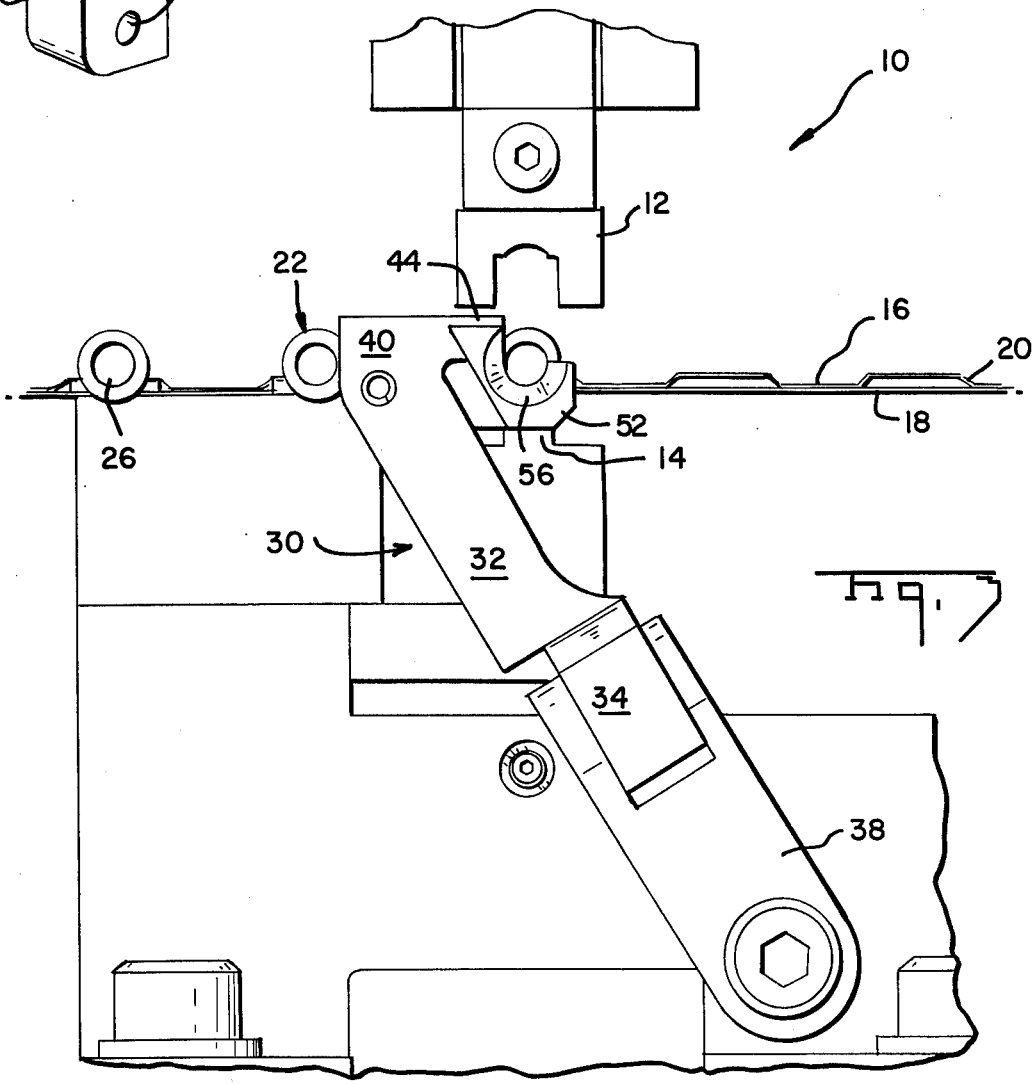

Subsequent to the wire barrel being crimped about the wire, indenter 12 is raised up and the carrier strip 16 advances the crimped terminal, indicated by reference numeral 60, beyond the crimping station as seen in FIG. 4. The wire cone assembly rotates clockwise along with the linear travel of crimped terminal 30 by synchronized movement between carrier strip 16 and mounting block 38 or alternatively, simply being carried along by the wire itself. After moving through an arc of about thirty degrees, the assembly and block 38 stops and is returned to the original FIG. 3 position. However the resistance of wire 28 which is still in the passage 54 causes the lever to pivot downwardly (FIG. 2b) so that the wire can move laterally out of the passage via slot 55. This pivotal movement is a factor in achieving the aforementioned increase in terminating rates.

A modification (not shown) to the present invention is provided for lower speed crimping presses. Since the speed of the carrier strip is less, there is no need for the wire cone assembly 30 to follow through as described above. Accordingly, the arm 32 remains stationary. The lever pivots downwardly by the lateral movement of the crimped wire to allow the wire to leave the passage's via slot 55.

Wire cone assembly can be molded from a plastic such as glass filled nylon or can be machined from steel or other metal.

The present invention works as well where terminals 22 have open or U-shaped wire barrels instead of the closed wire barrels 26 shown and described.

The foregoing detailed description has been given for clearness of understanding only, and no unnecessary limitations should be understood therefrom, as some modifications will be obvious to those skilled in the art.

What is claimed is:

1. A wire cone assembly for use on a crimping press of the type having a crimping station and crimping dies for crimping a wire barrel terminal about an electrical wire and means for moving the crimped terminal laterally from the station, said wire cone assembly comprising:

a. an elongated arm with its lower end attached to a rotatable mounting block on the crimping press and having a laterally projecting member on its upper end;

b. an L-shaped lever having a first section positioned parallel to the laterally projecting member and a second section positioned at a right angle to the first section and extending across the free end of the laterally projecting member, said second section having a partially conical passage therethrough opening out in front of the crimping station and further having a slot on an upwardly facing surface extending for the length of the section and intersecting the passage so that a multi-strand wire may be laid into the passage through the slot for subsequent insertion into a wire barrel which may be positioned in the crimping station, said first section being pivotally attached at its free end to the laterally projecting member, so that as the moving means on the crimping press move a crimped terminal from the crimping station, the wire lying in the passage with one end in the crimped terminal causes said lever to rotate downwardly so that the slot faces sideways permitting the wire to leave the passage therethrough.

2. The wire cone assembly of claim 1 further having stop means on the other end of the elongated arm to limit the rotational movement of the lever.

3. The wire cone assembly of claim 1 wherein a length of the walls of the passage are straight.

4. The wire cone assembly of claim 1 wherein the stop means inlcude a laterally projecting hook-like member and a finger extending from the hook-like member with the second section of the L-shaped lever extending under the finger.

5. The wire cone assembly of claim 1 further including biasing means for biasing the second section against the stop means.

* * * * *